US008410433B2

(12) United States Patent
Wuest et al.

(10) Patent No.: US 8,410,433 B2
(45) **Date of Patent: *Apr. 2, 2013**

(54) MASS SPECTROMETER

(75) Inventors: Martin Wuest, Malans (CH); Wolfram Knapp, Moser (DE)

(73) Assignee: INFICON GmbH, Bad Ragaz (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,925

(22) Filed: Aug. 9, 2011

(65) Prior Publication Data

US 2011/0291005 A1 Dec. 1, 2011

Related U.S. Application Data

(63) Continuation of application No. 12/376,542, filed as application No. PCT/CH2007/000371 on Jul. 27, 2007, now Pat. No. 8,071,941.

(51) Int. Cl.
*H01J 49/26* (2006.01)
*G21K 5/04* (2006.01)

(52) U.S. Cl. ..... 250/288; 250/281; 250/282; 250/423 R

(58) Field of Classification Search ..... 250/281, 250/282, 288, 423 R, 424, 423 P
See application file for complete search history.

(56) References Cited

U.S. PATENT DOCUMENTS

| | | | | |
|---|---|---|---|---|
| 4,272,699 | A * | 6/1981 | Faubel et al. | 313/360.1 |
| 4,450,031 | A * | 5/1984 | Ono et al. | 156/345.39 |
| 4,988,869 | A * | 1/1991 | Aberth | 250/281 |
| 7,352,187 | B2 | 4/2008 | Knapp et al. | |
| 8,071,941 | B2 * | 12/2011 | Wuest et al. | 250/288 |
| 2002/0171367 | A1 * | 11/2002 | Giapis et al. | 315/111.21 |
| 2004/0032194 | A1 | 2/2004 | Koga | |
| 2005/0077897 | A1 | 4/2005 | Syms | |
| 2006/0027764 | A1 * | 2/2006 | Liu et al. | 250/492.22 |

FOREIGN PATENT DOCUMENTS

GB 2453702 6/2011

OTHER PUBLICATIONS

Cold Cathode Field Emitter Array on A Quadrupole Mass Spectrometer: Route to Miniaturization, T.E. Felter.

* cited by examiner

*Primary Examiner* — Nicole Ippolito
(74) *Attorney, Agent, or Firm* — Notaro, Michalos & Zaccaria P.C.

(57) ABSTRACT

A cathode configuration for emission of electrons has a reaction zone connected to an entrance opening for the supply of neutral particles. The opening communicates with the cathode configuration for the ionization of the neutral particles and an ion extraction system communicates with the reaction zone. Ions from the extraction system are sent to a detection system and a mechanism for the evacuation of the mass spectrometer arrangement. The cathode configuration includes a field emission cathode with an emitter surface, wherein at a short distance from this emitter surface, an extraction grid is disposed for the extraction of electrons, which grid substantially covers the emitter surface. The emitter surface encompasses herein at least partially a hollow volume such that a tubular structure is formed.

47 Claims, 3 Drawing Sheets

MASS SPECTROMETER

CROSS-REFERENCE TO RELATED APPLICATIONS

This is a continuation of U.S. patent application Ser. No. 12/376,542 filed Feb. 5, 2009 and now U.S. Pat. No. 8,071,941, which is a 371 application of PCT/CH2007/000371 filed Jul. 27, 2007, which two applications are incorporated herein by reference, and which claims priority from Swiss patent application no. 1380/06 filed Aug. 29, 2006, which claim of priority is repeated here.

FIELD AND BACKGROUND OF THE INVENTION

The invention relates to a mass spectrometer arrangement.

Mass spectrometric measuring methods are currently applied in manifold type and manner in the field of process engineering, technology and product development, medicine and in scientific research. Typical application areas are herein leakage testing of structural parts in various industrial fields, quantitative determination of the composition and purity of process gases (partial pressure determination of gas fractions), complex analyses of reactions on surfaces, investigation and process monitoring in chemical and biochemical procedures and processes, analyses in the area of vacuum engineering, for example of plasma processes, such as, for example, in the semiconductor industry, etc.

For this purpose a multiplicity of different methods for the physical mass separation of particles has been developed and, correspondingly, measuring instruments for practical use have been realized. All of these measuring instruments have in common that they require vacuum for their operation. The neutral particles to be analyzed are inducted into the vacuum of the system and ionized in a reaction zone. This component is conventionally referred to as ion source. The ionized particles are subsequently conducted out of this zone with the aid of an ion optics and supplied to a system for mass separation. There are various concepts for the mass separation. For example, in one case the ions are deflected via a magnetic field, wherein, depending on their mass, the particles are subject to large deflection radii which can be detected. Such a system is known by the name sector field mass spectrometer. In a further, very widely used system the mass filter is comprised of an electrostatic system of four rods into which the ions are shot. On the rod system is impressed a high-frequency alternating electrical field, whereby the ions execute oscillations of different amplitude and trajectory, which can be detected and separated. Among experts this system is known as a quadrupole mass spectrometer. This mass spectrometer has various advantages such as, in particular, high sensitivity, wide measuring range, high measurement repetition rate, small dimensions, arbitrary mounting orientation, direct compatibility in important applications in vacuum engineering and good operability.

The ion sources of these known mass spectrometers conventionally employ a thermionic cathode which includes a heated filament, thus an incandescent cathode, for the generation of electrons which ionize the neutral particles under bombardment. While on this conceptual basis, the quality, for example of the quadruple spectrometer, is already quite good, the thermionic cathodes utilized, however, have various disadvantages which then also have an overall negative effect on the mass spectrometer.

One problem is that from an incandescent cathode, material of the filaments is also always vaporized and thereby undesirable particles are superimposed on the particles to be measured, which increases the so-called signal noise and consequently negatively effects the measuring accuracy or falsifies the measurement signal.

A further problem consists in that on or in the proximity of the hot filament chemical reactions take place with the particles to be measured and thereby the measurement is falsified and the resolution decreased. The emission of light, thus of photons which can interact, is herein of disadvantage. The hot arrangement leads additionally to increased temperature fluctuations which result in increased drift behavior and poor reproducibility of the measurement results. A filament, moreover, is vibration-sensitive, which can lead to undesirable signal fluctuations (microphony) or even to breakage under severe shock.

SUMMARY OF THE INVENTION

The present invention addresses the problem of eliminating or reducing the disadvantages of the prior art. The problem in particular is involved by providing a mass spectrometer arrangement which permits generating an undisturbed spectrum of the gas to be measured at a better signal/noise ratio, which permits higher resolution and sensitivity and to achieve this in particular for quadrupole mass spectrometer arrangements. The mass spectrometer arrangement, additionally, is to be economically producible.

The problem is resolved with the mass spectrometer arrangement of the invention.

According to the invention the mass spectrometer arrangement comprises a cathode configuration for the emission of electrons, a reaction zone, which is connected with an entrance opening for the supply of neutral particles, wherein this opening is operatively connected with the cathode configuration, for the ionization of neutral particles, an ion extraction system, which is disposed such that it communicates with the effective region of the reaction zone, means for guiding ions to a detection system within the mass spectrometer arrangement and means for evacuating the mass spectrometer arrangement. The cathode configuration herein includes a field emission cathode with an emitter surface, wherein at a short distance from this emitter surface is disposed an extraction grid for the extraction of electrons, which grid substantially covers the emitter surface. The emitter surface herein encompasses at least partially a hollow volume, such that a tubular structure is formed.

The formation according to the invention of the field emission cathode configuration within the mass spectrometer arrangement permits the cold operation without photon emission in the ion source avoiding the problems listed above, which leads to the corresponding substantial improvement of the properties of the mass spectrometer. Such a cathode and ion source is, moreover, simpler to construct and fewer measures need also to be expended in the remaining parts and in the electronic evaluation circuitry for error compensation. This leads to greater economy of production of the entire measuring system and offers better capabilities for analyzing the results, such as the generated spectra.

The various features of novelty which characterize the invention are pointed out with particularity in the claims annexed to and forming a part of this disclosure and are entirely based on Swiss priority application no. 1380/06 filed Aug. 29, 2006, and International application PCT/CH2007/000371 filed Jul. 27, 2007, and U.S. patent application Ser.

No. 12/376,542 filed Feb. 5, 2009, the PCT and U.S. applications being incorporated here by reference.

BRIEF DESCRIPTION OF THE DRAWINGS

In the following the invention will be described schematically and by example in conjunction with the drawings wherein.

DESCRIPTION OF THE PREFERRED EMBODIMENTS

Figure 1:
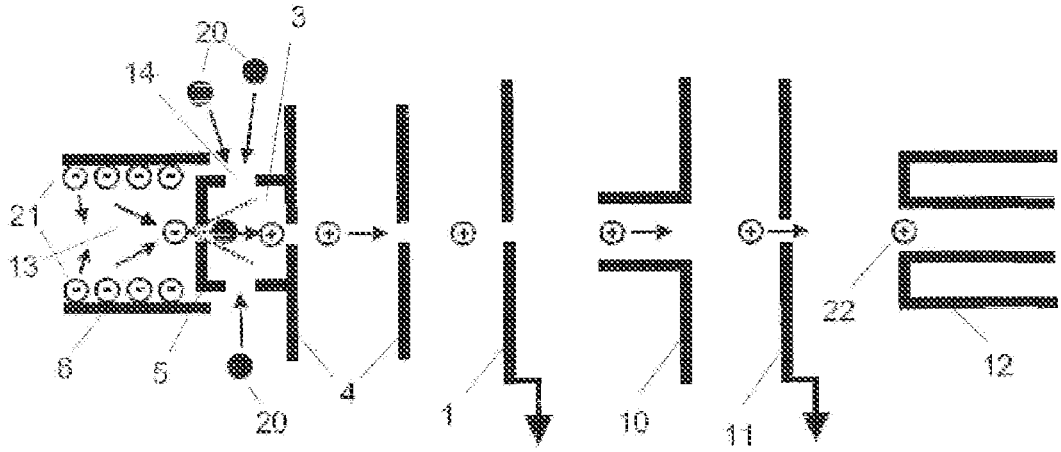
FIG. 1 is a schematic sectional view taken along the longitudinal axis a mass spectrometer arrangement according to the invention with lateral, radial feeding of the neutral particles into the ion source.

A mass spectrometer arrangement according to the invention comprises substantially an ion source 6, 4, 5, an ion optics 4, 1, 10, 11 for the extraction and guidance of the ions 22, as well as an analyzer system 12, as is depicted in longitudinal section in FIG. 1 in the preferred example of a quadrupole mass spectrometer with a rod system 12 as the analyzer.

Figure 3:
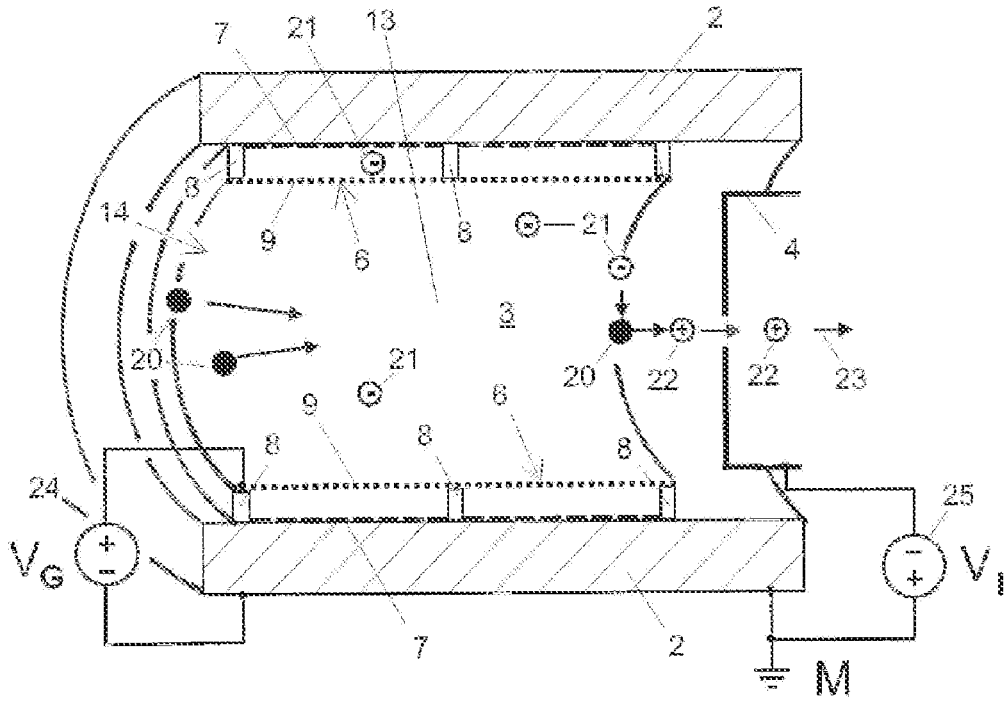
FIG. 3 is an enlarge sectional view taken along the longitudinal axis and depicting a more detailed view of the cathode configuration of the mass spectrometer arrangement according to the invention of FIG. 2.

The ion source includes a cathode configuration 6 which includes an emitter surface 7 as field emitter, which is formed as a two-dimensional field emission cathode and at a short distance in front of this surface 7 an extraction grid 9 is disposed which is impressed with a voltage source 24 at a voltage $V_G$ with respect to the emitter surface 7 for the formation and extraction of electrons 21, as is also shown in detail in FIG. 3. The extraction voltage $V_G$ on the extraction grid 9 is set to a positive value in the range between 70 V to 2000 V for the extraction of electrons 21. For the overall dimensioning herein a voltage in the range of 70 V to 200 V is especially advantageous. The extraction grid 9 can be produced from a metal sheet with apertures, an etched structure with apertures or preferably a wire mesh with as large a transmission factor for the electrons as possible. The extraction grid 9 should as much as possible be disposed at a uniform distance over the emitter surface 7. For this purpose, insulating etched support elements can be provided, preferably insulating spacer elements 8, which are correspondingly distributed on the surface in order to be able to maintain stably the desired specified distances.

The distance between the extraction grid 9 and the emitter surface 7 should be set to a value in the range of 1.0 μm and 2.0 mm, advantageously to a value in the range of 5.0 μm and 200 μm, which simplifies the structuring. The selected value is advantageously to be substantially uniformly employed over the entire emitter surface.

The emitter surface 7 is formed as an arcuate surface and encompasses at least partially a hollow volume 13 such that a tubular structure is formed. It can also be divided into sector elements, thus have discontinuities. In this case only the emitter surface 7 as a layer can itself be divided and not the support or the support can also be divided. However, preferred is a substantially nondivided surface which is self-closing and thereby the hollow volume 13, at least on the wall of the tubular structure, is also closed. The tubular structure is advantageously formed substantially cylindrically. This simplifies the structuring and permits better signal optimization.

The dimension of the emitter surface 7 should be in the range from 0.5 $cm^2$ to 80 $cm^2$, the range from 1.0 $cm^2$ to 50 $cm^2$ being preferred. The diameter of the formed hollow volume 13 is in the range between 0.5 cm and 8.0 cm, preferably in the range from 0.5 cm to 6.0 cm. The length of the hollow volume 13 in the axial direction is in the range between 2.0 cm and 8.0 cm.

The emitter surface 7 is comprised of an emitter material or is produced as a coating from this material, this material containing at least one of the materials of carbon, metal or a metal mixture, a semiconductor, a carbide or mixtures of these materials. Preferred are herein metals, in particular molybdenum and/or tantalum. Especially preferred are corrosion-resistant steels. Mixtures of these metals can also be employed. If the emitter surface 7 is deposited as a thin layer onto the wall 2 of a support, vacuum processes are preferred, such as chemical vapor deposition (CVD) and physical vapor deposition (PVD).

An especially advantageous implementation of the emitter surface 7 comprises that this surface is comprised of the material of the wall 2 of the support itself and covers at least a portion of the surface of the housing wall 2 thus formed, preferably however assumes, if possible, the entire surface of wall 2 which encompasses the hollow volume 13. The housing wall 2 comprises in this case one of the above listed metals itself or a metal alloy, preferably a corrosion-resistant steel. The wall 2 could also be covered with a type of sleeve of the emitting material. If the housing wall 2 and the emitter surface 7 are comprised of the same material, the arrangement can be realized more simply and better. The housing wall can in this case also be formed directly as a vacuum housing, whereby a further simplification is attained. It is then also of advantage if the housing wall 2, and therewith the emitter surface 7, is electrically at ground potential, as is shown in FIG. 3. Consequently, the electron emitter or the emitter surface 7 is implemented as a type of tube wall emitter.

The surfaces of said coating or the surface of the solid material of the housing wall 2 must be roughened such that a suitable emitter surface 7 is formed, which subsequently has field emission properties, such that it is capable of emitting sufficient electrons 21 at the low grid extraction voltage $V_G$. The roughening can be carried out mechanically, preferably by etching, such as plasma etching or preferably through chemical etching. Hereby in extremely simple manner a multiplicity of irregularly distributed prominences is generated, which are sharp-edged and/or tip-like with dimensions in the nanometer range, whereby field emission of electrons is possible even at low field strengths. Such prominences have heights compared to the mean base surface within a range of 10 nm to 1000 nm, preferably within 10 nm to 100 nm.

Known field emitters, such as Spint Mikrotips, are structured, for example, as an array-form uniformly distributed tip arrangement. This takes place through multiple, complex erosion and application of material. For this purpose complex and expensive multi-stage structuring processes are necessary. Such processes can also not take place on any surface, such as for example on inner surfaces of small tubular parts.

In contrast, in the present invention the present surface is roughened simply. The roughening herein takes place exclusively using a single structuring step, such that the desired sharp-edged or tip-like elements are formed, which permit the desired field emission. In the mechanical working of the surface this is generated, for example, through a grinding process. In the preferred etching this is generated through the inherently present grain structure of the basic material. The emitting tips are thereby distributed stochastically.

The electrons 21 generated in such manner with the cathode configuration 6 and accelerated impinge within a reaction zone 3 onto the neutral particles 20 which are here ionized. The reaction zone 3 is thus connected with an entrance opening 14 for the supply of neutral particles 20.

In an embodiment of the invention, such as depicted in FIG. 1, the hollow volume 13 of the cathode configuration 6 is adjoined by an electron extraction lens 5, which extracts the electrons 21 in the axial direction of the mass spectrometer arrangement from this hollow volume 13 and guides them into a reaction zone 3 where through electron collision the neutral particles 21 are ionized. Opposite the electron extraction lens 5 is disposed at a spacing in the axial direction the ion extraction lens 4. These two lenses 4, 5 encompass the reaction volume 3. In the arrangement depicted here, the two extraction lenses can be at the same electric potential, they thus form together with a wall encompassing the reaction zone 3 a type of housing in whose wall openings 14 are provided for the transit of neutral particles 20 to be measured. The ion extraction lens 4 includes a lens opening at which a field penetration factor through the succeeding electro-optical elements is brought about whereby the ions are extracted from the ionization region of the reaction zone 3 in the axial direction.

The neutral particles 20 in this formation are admitted into this reaction volume 3 radially with respect to the axis, laterally of the reaction volume 3 through the entrance opening 14. The extracted ions 22 are guided through the ion optics 4, 1 onto a focusing means 10, 11 and subsequently into the analyzer 12. In the preferred quadrupole mass spectrometer the ion optics includes, for example, an extraction lens 4 and a further lens 1, here shown as base plate at ground potential and the succeeding focusing means includes a focusing lens 10 and an injection aperture plate 11, as well as the detection system as a four-fold rod system. In FIG. 1 is shown an arrangement with the reaction volume 3 separated from the hollow volume 13 of the cathode configuration 6 and lateral supply of the neutral particles 20.

The entire arrangement is, in addition, developed such that for operation it can be evacuated, be that by flanging it to pumped vacuum systems and/or by providing it with its own pumps.

Figure 2:
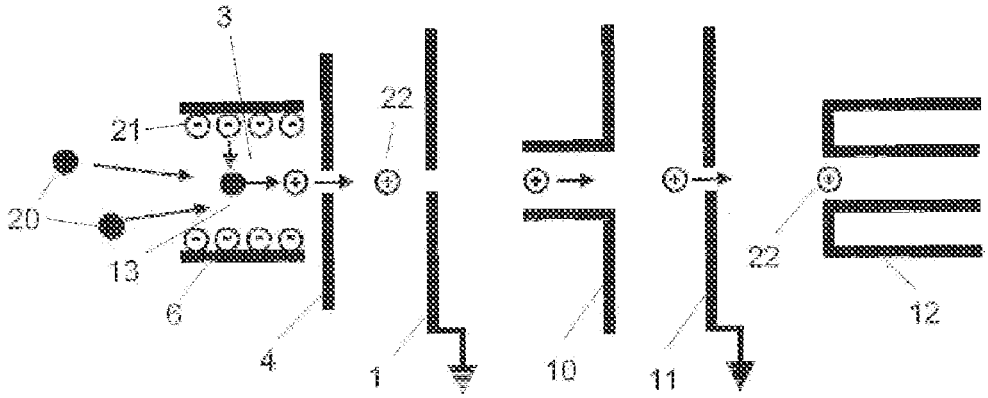
FIG. 2 is a schematic sectional view taken along the longitudinal axis of a further, preferred mass spectrometer arrangement according to the invention with axial feeding of the neutral particles into the ion source.

A further preferred embodiment of the invention is depicted in FIG. 2 and in detail in FIG. 3. The Figures also show schematically the preferred implementation on a quadrupole mass spectrometer arrangement. The emitter surface 7 of the field emitter is disposed on the tube wall such that the reaction zone 3 is located within the hollow volume 13 and that here the ionization takes place. The ionization volume consequently is located within the electron source or the cathode configuration 6. In addition to the omission of a focusing device 5, a substantially simplified structuring results since no separate ionization volume is required. Nevertheless, the necessary potential relations are substantially maintained, since the extraction grid 9 with respect to the emitter surface 7 or the wall 2 is at a positive potential $V_G$ and this surface or wall is advantageously at ground potential M. The emitter surface 7 forms thus together with the grid 9 the electron source. The voltage $V_G$ at the extraction grid 9 has a value in the range of 70 V to 2000 V, depending on which material for the emitter surface 7 and which distance of the extraction grid 9 from the emitter surface 7 has been selected. Values in the range of 70 V to 200 V are especially suitable since in the present implementation of the cathode configuration sufficient electrons 21 can always still be generated whereby a further simplification of the system becomes possible. The ion extraction lens 4 is disposed at the end side with respect to the hollow volume 13 or to the reaction zone 3 and in the simplest case is comprised of an aperture plate. By applying with a voltage source 25 a negative voltage $V_I$ with respect to the emitter surface 7 or the wall 2, the ions are extracted in the axial direction out of the hollow volume 13 and moved in the direction of the detection system 12 and thus to the mass filter system. At higher values of the extraction voltage $V_G$ a slightly positive voltage $V_I$ is also possible if it is markedly lower than $V_G$.

The neutral particles 20 to be analyzed are admitted through an entrance opening 14 into the hollow volume 13 of the tubular cathode configuration. This entrance opening is located at the end side with respect to the tubular hollow volume 13, opposite to the ion extraction lens 4. The tubular cathode configuration 6 with the ion extraction lens 4 is advantageously axially oriented, thus in line with respect to the longitudinal axis of the quadrupole mass spectrometer arrangement. The motion direction 23 of the extracted ions 22 leads here along the longitudinal axis in the direction of the analyzer 12.

FIG. 3 depicts by way of example in detail a preferred arrangement with a plate-like ion extraction lens 4, which, for the extraction of the ions, includes in its center an aperture as lens opening and which is not connected with the wall 2 under a vacuum seal. The remaining portion of the mass spectrometer arrangement is here evacuated through the electron or ion source, which also simplifies the structuring in terms of vacuum engineering.

Figure 4:
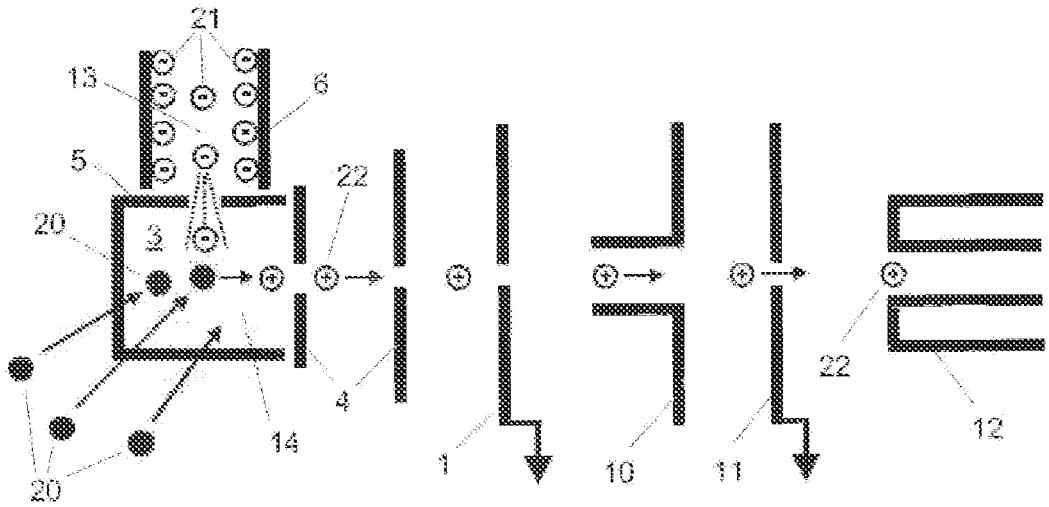
FIG. 4 is a schematic sectional view taken along the longitudinal axis of a still further, preferred mass spectrometer arrangement according to the invention with orthogonally disposed cathode configuration for the radial feeding of the electrons into the ion source.

A further preferred arrangement according to the invention is shown in FIG. 4 in section along the longitudinal axis. The cathode configuration 6 is here disposed orthogonally to the longitudinal axis of the mass spectrometer, thus laterally of the ion source which also, as is also shown in FIG. 1, is realized as a type of closed chamber 5, wherein the lateral chamber wall includes an opening toward the cathode configuration 6 and thus forms the electron extraction lens 5. The electron extraction lens 5 itself, as stated, is here formed as a type of chamber and thereby encompasses the reaction zone 3 for the ionization of the neutral particles 20. In addition, in the wall of this chamber one or several openings 14 are provided for the introduction of the neutral particles 20 to be analyzed. In the axial direction this chamber 3 terminates again with an ion extraction lens 4 for the extraction of the formed ions into the analyzer of the mass spectrometer.

Figure 5:
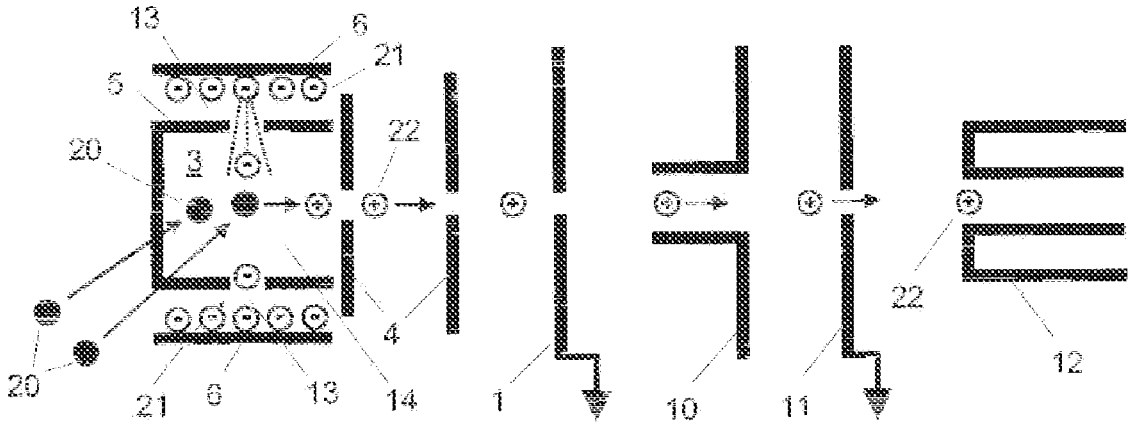
FIG. 5 is a schematic sectional view taken along the longitudinal axis of a further, preferred mass spectrometer arrangement according to the invention with the cathode configuration disposed coaxially to the ion source for the radial feeding of the electrons into the ion source.

FIG. 5 depicts a further preferred embodiment, in which the tubular cathode configuration 6 is disposed coaxially to the longitudinal axis of the mass spectrometer arrangement and the electron extraction lens 5 formed like a chamber, such as has been described previously in conjunction with FIG. 4. The cathode configuration 6 encompasses herein the chamber with the reaction zone 3, at least partially, whereby it becomes possible to place optionally on the periphery of the wall of the chamber, thus of the extraction lens 5, an opening or preferably two or even several extraction openings for the electrons 21. The neutral particles 20 are also, as depicted in the arrangement according to FIG. 4, inducted through at least one opening 14 in the chamber wall.

Through the arrangement according to FIGS. 4 and 5 with the radial shooting of the electrons 21 into the reaction zone 3, compared to the axial disposition, a better separation of the ions to be measured compared to other undesirable particles is possible, which could also reach the analyzer and subsequently would degrade the measuring quality.

The invention claimed is:

1. A mass spectrometer arrangement having a detection system (12) and comprising:

a cathode configuration (6) for emitting electrons (21);

a reaction zone (3) having an entrance opening (14) for a supply of neutral particles (20), the reaction zone being operatively connected to the cathode configuration (6) for ionization of the neutral particles (20) in an effective region of the reaction zone to form ions (22);

an ion extraction system (4) communicating with the effective region of the reaction zone (3);

guidance means (1, 10, 11) for guidance of the ions (22) to the detection system (12) within the mass spectrometer arrangement;

evacuation means for evacuation of the mass spectrometer arrangement;

the cathode configuration (6) comprising a field emission cathode with an emitter surface (7) and, at a short distance from the emitter surface (7), an extraction grid (9) for extraction of electrons (21) away from the emitter surface, the extraction grid substantially covering the emitter surface (7), and the emitter surface (7) at least partly encompassing a hollow volume (13) to create a tubular structure around the hollow volume (13), wherein the emitter surface (7) is a surface which has been subjected to etching to thereby form a rough surface.

2. The arrangement as claimed in claim 1, wherein the size of the emitter surface (7) is in the range of 0.5 $cm^2$ to 80 $cm^2$.

3. The arrangement as claimed in claim 1, wherein the emitter surface (7) is substantially shaped as a concave inside-facing surface of longitudinal side walls of a cylinder, and wherein the extraction grid is shaped as a second cylinder radially inside the emitter surface cylinder.

4. The arrangement as claimed in claim 1, wherein the emitter surface (7) is a thin layer deposited on a housing wall (2) formed by one of CVD and PVD.

5. The arrangement as claimed in claim 1, wherein the emitter surface (7) is a roughened surface which has been subjected to etching to form a multiplicity of irregularly distributed prominences.

6. The arrangement as claimed in claim 1, wherein the extraction grid (9) is positioned opposite the emitter surface (7) with insulating spacers (8).

7. The arrangement as claimed in claim 1, wherein the extraction grid (9) is biased with respect to the emitter surface (7) with a positive voltage ($V_G$) and that this voltage is in the range from 70 V to 2000 V.

8. The arrangement as claimed in claim 1, wherein the detector system (12) includes a rod system which is part of a quadrupole mass spectrometer.

9. A mass spectrometer arrangement having a detection system (12) and comprising:

a cathode configuration (6) for emitting electrons (21);

a reaction zone (3) having an entrance opening (14) for a supply of neutral particles (20), the reaction zone being operatively connected to the cathode configuration (6) for ionization of the neutral particles (20) in an effective region of the reaction zone to form ions (22);

an ion extraction system (4) communicating with the effective region of the reaction zone (3);

guidance means (1, 10, 11) for guidance of the ions (22) to the detection system (12) within the mass spectrometer arrangement;

evacuation means for evacuation of the mass spectrometer arrangement;

the cathode configuration (6) comprising a field emission cathode with an emitter surface (7) and, at a short distance from the emitter surface (7), an extraction grid (9) for extraction of electrons (21) away from the emitter surface, the extraction grid substantially covering the emitter surface (7), and the emitter surface (7) consisting essentially of generally planar surface, the emitter surface (7) being curved and at least partly encompassing a hollow volume (13) to create a hollow tubular structure, wherein, adjoining the hollow volume (13) of the cathode configuration (6) is an electron extraction lens (5) and including, in an axial direction of the mass spectrometer arrangement, an ion extraction lens (4), the reaction zone (3) being located between the electron extraction lens (5) and the ion extraction lens (4) to form a volume and the entrance opening (14) for the neutral particles (20) being disposed peripherally upon said volume of the reaction zone (3).

10. The arrangement as claimed in claim 9, wherein the size of the emitter surface (7) is in the range of 0.5 $cm^2$ to 80 $cm^2$.

11. The arrangement as claimed in claim 9, wherein the size of the emitter surface (7) is in the range of 1.0 $cm^2$ to 50 $cm^2$.

12. The arrangement as claimed in claim 9, wherein the emitter surface (7) forms at least arcuate sector elements that are not divided and forms a closed tubular emitter surface (7) wherein the emitter surfaces are concave and face inwards.

13. The arrangement as claimed in claim 9, wherein the emitter surface (7) is substantially shaped as a concave inside-facing surface of longitudinal side walls of a cylinder, and wherein the extraction grid is shaped as a second cylinder radially inside the emitter surface cylinder.

14. The arrangement as claimed in claim 9, wherein the diameter of the hollow volume (13) is between 0.5 cm and 8.0 cm and its length in the axial direction is between 2.0 em and 8.0 cm.

15. The arrangement as claimed in claim 9, wherein the diameter of the hollow volume (13) is between 0.5 cm and 6.0 cm and its length in the axial direction is between 2.0 cm and 8.0 cm.

16. The arrangement as claimed in claim 9, wherein the emitter surface (7) comprises at least on the surface a layer comprising at least one of the materials selected from the group consisting of: carbon; a metal; a metal mixture; a semiconductor; a carbide; and mixtures thereof.

17. The arrangement as claimed in claim 16, wherein the emitter surface (7) is substantially comprised of at least one of molybdenum, tantalum and corrosion-resistant steel.

18. The arrangement as claimed in claim 16, wherein the emitter surface (7) is a thin layer deposited on a housing wall (2) formed by one of CVD and PVD.

19. The arrangement as claimed in claim 9, wherein the emitter surface (7) is comprised of at least a portion of the surface of one housing wall (2), wherein the housing wall (2) is comprised of one of: metal, metal alloy, and corrosion resistant steel.

20. The arrangement as claimed in claim 9, wherein the emitter surface (7) is a roughened surface which has been subjected to etching to form a multiplicity of irregularly distributed prominences.

21. The arrangement as claimed in claim 9, wherein the emitter surface (7) is a roughened surface that is roughened by one of: mechanically roughened; plasma etching; and chemical etching.

22. The arrangement as claimed in claim 9, wherein the distance between the extraction grid (9) and the emitter surface (7) is in the range from 1.0 μm and 2 mm.

23. The arrangement as claimed in claim 9, wherein the distance between the extraction grid (9) and the emitter surface (7) is in the range from 5.0 μm and 200 μm.

24. The arrangement as claimed in claim 9, wherein the extraction grid (9) has a grid structure with high transmission factor and is made of wire cloth.

25. The arrangement as claimed in claim 9, wherein the extraction grid (9) is positioned opposite the emitter surface (7) with insulating spacers (8).

26. The arrangement as claimed in claim 9, wherein the extraction grid (9) is biased with respect to the emitter surface (7) with a positive voltage ($V_G$) and that this voltage is in the range from 70 V to 2000 V.

27. The arrangement as claimed in claim 9, wherein the extraction grid (9) is biased with respect to the emitter surface (7) with a positive voltage ($V_G$) and that this voltage is in the range from 70 V to 200 V.

28. The arrangement as claimed in claim 9, wherein the detector system (12) includes a rod system which is part of a quadrupole mass spectrometer.

29. The arrangement as claimed in claim 9, wherein the emitter surface comprises roughened generally planar surface which has been roughened by mechanical grinding.

30. A mass spectrometer arrangement having a detection system (12) and comprising:

a cathode configuration (6) for emitting electrons (21);

a reaction zone (3) having an entrance opening (14) for a supply of neutral particles (20), the reaction zone being operatively connected to the cathode configuration (6) for ionization of the neutral particles (20) in an effective region of the reaction zone to form ions (22);

an ion extraction system (4) communicating with the effective region of the reaction zone (3);

guidance means (1, 10, 11) for guidance of the ions (22) to the detection system (12) within the mass spectrometer arrangement;

evacuation means for evacuation of the mass spectrometer arrangement;

the cathode configuration (6) comprising a field emission cathode with an emitter surface (7) and, at a short distance from the emitter surface (7), an extraction grid (9) for extraction of electrons (21) away from the emitter surface, the extraction grid substantially covering the emitter surface (7), and the emitter surface (7) consisting essentially of generally planar surface, the emitter surface (7) being curved and at least partly encompassing a hollow volume (13) to create a hollow tubular structure, wherein the reaction zone (3) is formed within the hollow volume (13) of the cathode configuration (6) so that the hollow volume (13) is delimited on one side by an ion extraction lens (4) and on an opposite side is located the entrance opening (14) for the neutral particles (20).

31. The arrangement as claimed in claim 30, wherein the size of the emitter surface (7) is in the range of 0.5 $cm^2$ to 80 $cm^2$.

32. The arrangement as claimed in claim 30, wherein the emitter surface (7) is substantially shaped as a concave inside-facing surface of longitudinal side walls of a cylinder, and wherein the extraction grid is shaped as a second cylinder radially inside the emitter surface cylinder.

33. The arrangement as claimed in claim 30, wherein the emitter surface (7) is a thin layer deposited on a housing wall (2) formed by one of CVD and PVD.

34. The arrangement as claimed in claim 30, wherein the emitter surface (7) is a roughened surface which has been subjected to etching to form a multiplicity of irregularly distributed prominences.

35. The arrangement as claimed in claim 30, wherein the extraction grid (9) is positioned opposite the emitter surface (7) with insulating spacers (8).

36. The arrangement as claimed in claim 30, wherein the extraction grid (9) is biased with respect to the emitter surface (7) with a positive voltage ($V_G$) and that this voltage is in the range from 70 V to 2000 V.

37. The arrangement as claimed in claim 30, wherein the detector system (12) includes a rod system which is part of a quadrupole mass spectrometer.

38. The arrangement as claimed in claim 30, wherein the emitter surface comprises roughened generally planar surface which has been roughened by mechanical grinding.

39. A mass spectrometer arrangement having a detection system (12) and comprising:

a cathode configuration (6) for emitting electrons (21);

a reaction zone (3) having an entrance opening (14) for a supply of neutral particles (20), the reaction zone being operatively connected to the cathode configuration (6) for ionization of the neutral particles (20) in an effective region of the reaction zone to form ions (22);

an ion extraction system (4) communicating with the effective region of the reaction zone (3);

guidance means (1, 10, 11) for guidance of the ions (22) to the detection system (12) within the mass spectrometer arrangement;

evacuation means for evacuation of the mass spectrometer arrangement;

the cathode configuration (6) comprising a field emission cathode with an emitter surface (7) and, at a short distance from the emitter surface (7), an extraction grid (9) for extraction of electrons (21) away from the emitter surface, the extraction grid substantially covering the emitter surface (7), and the emitter surface (7) consisting essentially of generally planar but also rough surface, the emitter surface (7) being curved and at least partly encompassing a hollow volume (13) to create a hollow tubular structure, wherein the reaction zone (3) is located on a longitudinal axis of the mass spectrometer arrangement and is encompassed by a wall which includes, in a radial direction toward the axis, an extraction opening which forms the electron extraction lens (5), and the extraction opening communicating with the hollow volume (13) of the cathode configuration (6), the cathode configuration (6) being positioned orthogonally with respect to the axis and to the reaction zone (3) for a radial feeding of the electrons into the reaction zone (3), and in the wall at least one entrance opening (14) is provided for the introduction of neutral particles (20).

40. The arrangement as claimed in claim 39, wherein the size of the emitter surface (7) is in the range of 0.5 $cm^2$ to 80 $cm^2$.

41. The arrangement as claimed in claim 39, wherein the emitter surface (7) is substantially shaped as a concave inside-facing surface of longitudinal side walls of a cylinder, and wherein the extraction grid is shaped as a second cylinder radially inside the emitter surface cylinder.

42. The arrangement as claimed in claim 39, wherein the emitter surface (7) is a thin layer deposited on a housing wall (2) formed by one of CVD and PVD.

43. The arrangement as claimed in claim 39, wherein the emitter surface (7) is a roughened surface which has been subjected to etching to form a multiplicity of irregularly distributed prominences.

44. The arrangement as claimed in claim 39, wherein the extraction grid (9) is positioned opposite the emitter surface (7) with insulating spacers (8).

45. The arrangement as claimed in claim 39, wherein the extraction grid (9) is biased with respect to the emitter surface (7) with a positive voltage ($V_G$) and that this voltage is in the range from 70 V to 2000 V.

46. The arrangement as claimed in claim 39, wherein the detector system (12) includes a rod system which is part of a quadrupole mass spectrometer.

47. The arrangement as claimed in claim 39, wherein the emitter surface comprises roughened generally planar surface which has been roughened by mechanical grinding.

* * * * *